United States Patent [19]

Hansen

[11] 3,971,315

[45] July 27, 1976

[54] MACROPOROUS MICROPOROUS MARKING STRUCTURE

[75] Inventor: Frederick C. Hansen, Union Grove, Wis.

[73] Assignee: Porelon, Inc., Racine, Wis.

[22] Filed: Aug. 12, 1974

[21] Appl. No.: 496,677

[52] U.S. Cl. ..... 101/333; 101/367; 101/401.1; 264/46.4; 428/311

[51] Int. Cl.[2] ..... B41K 1/42

[58] Field of Search ..... 101/395; 401.1, 367, 101/379, 333; 264/46.4, 45.5; 428/311

[56] References Cited

UNITED STATES PATENTS

| | | | |
|---|---|---|---|
| 2,052,490 | 8/1936 | Reinhardt et al. | 264/46.4 |
| 2,320,425 | 6/1943 | Glaes et al. | 264/46.4 |
| 2,648,619 | 8/1953 | Alderfer | 428/311 |
| 3,255,061 | 6/1966 | Dobbs | 264/46.4 |
| 3,380,380 | 4/1968 | Funahashi | 101/379 |
| 3,413,184 | 11/1968 | Findlay et al. | 264/45.5 |
| 3,464,872 | 9/1969 | Everett | 264/46.4 |
| 3,491,685 | 1/1970 | Tramposch | 101/367 |
| 3,511,788 | 5/1970 | Keil | 428/311 |
| 3,720,572 | 3/1973 | Soda et al. | 264/321 |
| 3,812,782 | 5/1974 | Funahashi | 101/367 |

*Primary Examiner*—Clyde I. Coughenour

[57] ABSTRACT

A marking structure for various uses, such as in hand stamps or other printing members, or in ink pads, ink rolls or other inking members. The marking structure is characterized by at least two layers, including an outer layer and an underlying reservoir layer. The outer layer has interconnected aggregates of thermoplastic resin, forming a microporous network of pores, and a marking fluid contained within the network. The reservoir layer has an open-pored macroporous structure, such as an open-cell polyurethane foam, impregnated with a microporous thermoplastic resin, in the form of interconnected aggregates, and an additional amount of the marking fluid. The resin aggregates of the outer and reservoir layers are joined at the interface of the layers to form a cohesive structure.

16 Claims, 9 Drawing Figures

MACROPOROUS MICROPOROUS MARKING STRUCTURE

BACKGROUND OF THE INVENTION

This invention relates generally to the field of structures for applying marking fluids of various types, including structures for use in marking stamps, such as hand stamps or other printing members, and ink pads, ink rolls, and other devices for applying ink to a marking or printing implement. Specifically, this invention relates to marking structures of the type containing their own essentially permanent supply of marking fluid, such that, for example, repetitive re-inking of the marking surface is unnecessary.

U.S. Pat. Nos. 2,777,824 and 3,055,297, both to Harry R. Leeds, disclose marking structures made of highly porous plastic material, the pores of which are of microscopic proporations and are filled with a marking fluid such as ink. Structures made in accordance with the teachings of the Leeds patents have experienced a high degree of commercial success as hand stamps, stamp pads, and also as ink rolls such as are used for applying ink to printing members in automatic printing equipment. Such structures are advantageous because of their long life, both in length of time and in numbers of operations or impressions, and because they operate well without the necessity of repetitive re-inking of the marking surface. Such structures apply ink in a uniform and reliable fashion. For example, hand stamps made using such structures, which have various characters or designs molded at their surface, provide sharp and uniform impressions with high definition and uniformity. As stamp pads, such structures place a uniform layer of ink on a marking device, such as a rubber stamp, and are reliable over long periods of time. Similarly, as ink rolls, such structures provide uniform inking of printing members and exhibit fast recovery to facilitate repetitive use over long periods of time.

However, there are certain problems and difficulties with microporous structures of this type. In particular, structures made according to the disclosures of U.S. Pat. Nos. 2,777,824 or 3,055,297 have exhibited a significant degree of dimensional instability. For example, during the useful lifetime of a hand stamp using such structures, the structure will undergo perceptible shrinkage, on the order of as high as 15–20 percent of its original size, by linear dimensions.

Another problem relates to the strength and integrity of structures made in accordance with the teachings of the Leeds patents. If undue stresses are placed on such structures, particularly shearing stresses on corners or on characters molded on the surfaces thereof, there is an occasional tendency for crumbling or breakage of small portions from the structure.

Another problem relates to the process of manufacture. For example, in the case of hand stamps, the total processing time may be a period on the order of about 15 hours. A lengthy period of time is primarily required for a "curing" step, in which the molded and sealed structure reaches an initial dimensional stability.

Macroporous ink-containing marking structures, such as those made of porous rubber, vinyl or urethane foam, do not have these problems. However, the overall quality and performance of such marking devices are considerably inferior to those made in accordance with the disclosures of the aforementioned Leeds patents. Specifically, such structures are known to have significant aging problems, form the standpoints of time and numbers of operations. Product life is quite short. Their resistance to high temperatures and humidity is low and dry-out is a significant problem. In printing members using such structures, there is often over-inking which produces a significant degree of feathering, wicking, bleeding and strike-through, all problems well-known to those skilled in the art.

My invention overcomes each of the aforementioned problems. The inventive structure normally undergoes shrinkage of no more than about 3-5% during its useful lifetime. Further, the inventive structures have greatly increased strength which drastically reduces the likelihood of crumbling or breakage.

In addition, the time required to produce the structures of this invention is only a fraction of that required in the prior art — the total processing time being about two hours for a typical hand stamp, primarily because no lengthy "curing" step is necessary.

In addition, the inventive structures have a substantially increased lifetime with respect to all structures known in the prior art. For example, while a typical hand stamp made in accordance with the teachings of the above-mentioned Leeds patents would have a useful lifetime on the order of 20,000 impressions, the useful lifetime of a comparable hand stamp which includes the inventive structure is on the order of 200,000 impressions, around a tenfold increase.

Another advantage over the structures disclosed in the aforementioned Leeds patents is that the inventive structure may be reloaded with marking fluid, if so desired, to further extend its usefulness.

Each of these advantages is brought about without sacrificing any of the other advantages of microporous marking structures of the type described in the above-mentioned Leeds patents.

BRIEF SUMMARY OF THE INVENTION

The marking structure of this invention is a multilayered structure having an outer layer which is used to apply a marking fluid, such as ink, for the intended purpose, and at least one reservoir layer underlying the outer layer and interconnected with the outer layer at the interface of the two layers. The outer layer has a microporous material formed of interconnected aggregates that is aggregated particles of a thermoplastic resin. The interconnected aggregates form a substantially uniform, unitary cohesive structure which defines a corresponding network of pores. The network of pores contains a marking fluid which is substantially incompatible with (nonsolvent to) the resin. The reservoir layer has an openpored macroporous elastomeric structure and a microporous material contained within the macroporous structure. The microporous material within the reservoir layer is a thermoplastic resin, such as the same resin used in the outer layer, in the form of interconnected aggregates which define, together with the macroporous structure, a network of spaces. Contained within the network of spaces is a marking fluid, such as the same marking fluid used in the outer layer, which is substantially incompatible with the thermoplastic resin of the reservoir layer and with that of the outer layer. The aggregates of thermoplastic resin within the macroporous structure are interconnected with the aggregates of thermoplastic resin of the outer layer at the interface of the two layers and a continuous network is formed between the two layers. Marking fluid in the reservoir layer replenishes the marking fluid content of the outer layer as it is depleted during usage of the inventive device.

The markedly improved performance of this invention is obtained when the open-pored macroporous structure is a substantially resilient material as opposed to a fairly rigid material. An especially effective open-pored macroporous structure, which greatly improves performance of this invention, is an open-celled thermoset elastomeric foam.

Significantly superior performance will be obtained when the open-pored macroporous structure is a network of interconnected strands of a polyurethane elastomer, such as materials made in accordance with the teachings of U.S. Pat. No. 3,171,820, to R. A. Volz. One such material is sold by Scott Paper Company, Philadelphia, Pennsylvania, under the trademark "SCOTTFELT".

The thermoplastic resin which is used in the outer layer and the thermoplastic resin used in the reservoir layer(s) are preferably the same resin, preferably a resin having the functional characteristics of resins in the following group: polyvinyl chloride, polyvinyl acetate, polyvinylidene chloride, copolymers of vinyl chloride and other ethylenically unsaturated monomers, and combinations thereof. Such thermoplastic resins will provide good performance in the marking structures of this invention. Plasticized copolymers of vinyl chloride and other ethylenically unsaturated monomers are highly preferred and give superior performance.

The advantages of this invention are greatly advanced when the weight ratio of marking fluid to plasticized thermoplastic resin in the reservoir layer is greater than the weight ratio of marking fluid to plasticized thermoplastic resin in the outer layer. For example, an ink-rich reservoir layer will increase the useful life of the marking device of this invention substantially, when compared to the prior art. In particular such ratios may be within the range of about 0.2–4.0 for the reservoir layer, and within the range of about 0.1–1.0 for the outer layer. Preferably, such ratios are within the range of about 0.6–2.0 for the reservoir layer and 0.3–0.7 for the outer layer. It is highly advantageous for performance to have the weight ratio for the reservoir layer at least about 50% greater than that of the outer layer. It is most preferred that this ratio be at least about 120 percent greater.

The greatest improvement in structural strength of the marking device of this invention is obtained when the thickness of the outer layer is substantially less than that of the reservoir layer. For example, in a hand stamp structure the reservoir layer may have a thickness of about 0.30 inches or more while the thickness of the overlying outer layer is about 0.10 inches. The thickness of the outer layer is preferably no more than about one-third the total thickness of the structure. When this structure is used as a printing member, the outer layer will typically have a base layer, adjacent the underlying reservoir layer, with a thickness of about 0.05 inches and an integrally extending layer of printing chracters having a thickness of about 0.05 inches. Structural strength of a printing structure according to this invention is greatly improved if the base layer and the layer of printing characters are of approximately equivalent thicknesses, and the total thickness of the outer layer is substantially less than that of the reservoir layer. Of course, the actual thickness (or "height") of a layer of printing characters is somewhat dependent on the size of the printing member. Acceptable thickness for the layer of printing characters for any given printing structure of this invention would be about the same as the height of printing characters used in structures made according to the disclosures of the aforementioned Leeds patents, and accordingly such are well-known to those skilled in the art.

It is the principal object of this invention to provide a marking device overcoming the aforementioned problems.

Another object of this invention is to provide a marking device, of the type having a generally permanent self-contained marking fluid, which has good dimensional stability over its useful lifetime and exhibits excellent performance in application of marking fluid.

Another object of this invention is to provide a marking device, of the type having a generally permanent self-contained marked fluid, which has improved structural strength and exhibits excellent performance in application of marking fluid.

Yet another object of this invention is to provide a marking device of the type described which has a greatly extended useful lifetime.

A further object of this invention is to provide a marking device of the type described which provides the advantages of macroporous fluid-containing marking structures with those of microporous fluid-containing marking structures.

BRIEF DESCRIPTION OF THE DRAWINGS

These and other objects will be apparent from the foregoing discussion the following description of preferred embodiments and from the drawings wherein.

DETAILED DESCRIPTION OF PREFERRED EMBODIMENTS

As used herein, the term "pores" means interstices, or voids, within a material, either at the surface of a piece of material or remote from the surface.

As used herein, "microporous" describes a material having pores small enough to prevent substantial "bleed-out" of marking fluid, small enough as to be not normally discernible by the naked eye, yet large enough to permit some flow therein of a marking fluid such as the fluids disclosed herein. For example, a material having a pore size of less than about 100 microns in diameter and greater than about 0.5 microns in diameter is known to function in this invention. The microporous pores of materials described herein are normally neither symmetrical nor similar to each other in shape and size. Indeed, such pores are quite irregular and varied in shape and size, and for this reason it may be difficult to determine the "diameter" of any given pore or the "average diameter" of pores of a particular material.

The term "macroporous" as used herein describes a material having pores large enough to contain aggregates of thermoplastic resin, as described herein. Macroporous pores are normally discernible to the naked eye. Macroporous pores according to this invention may be quite large, However, it has been observed that the use, in the reservoir layer, of material having pore sizes exceeding about 0.25 centimeters in diameter usually results in a marking structure having only marginal advantages over devices made in accordance with the teachings of the aforementioned Leeds patents. Because of the irregularity in shape and size of the pores of the macroporous structures used in this invention, it may be difficult to determine the "diameter" of any given pore or the "average diameter" of pores of a particular material.

Figure 1:
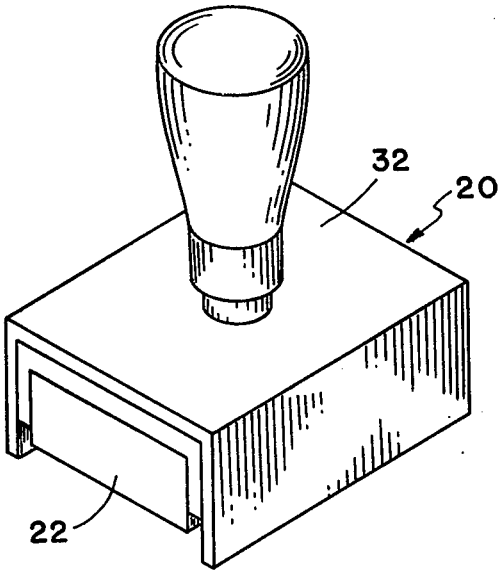
FIG. 1 is a perspective view of a hand stamp having a marking structure of this invention.
Figure 2:
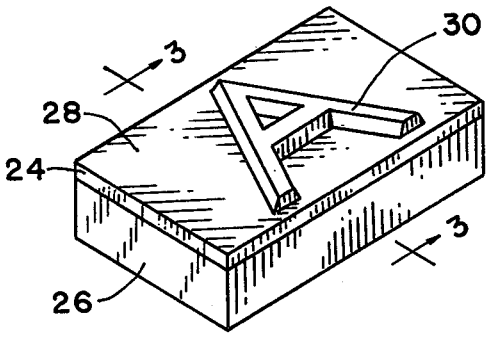
FIG. 2 is an inverted perspective view of the marking structure portion of FIG. 1.

FIG. 1 illustrates a hand stamp 20 having a marking structure 22 according to this invention. As shown in FIG. 2, marking structure 22 is a block structure having two layers including an outer layer 24 and an adjacent reservoir layer 26. Outer layer 24 and reservoir layer 26 contain a marking fluid which is applied, through outer layer 24, to various surfaces such as paper.

Figure 3:
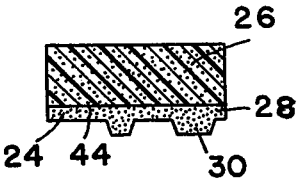
FIG. 3 is a sectional view of the marking structure of FIG. 2, taken along section 3—3 as indicated in FIG. 2.

FIG. 3 shows a cross-section of marking structure 22. Outer layer 24 has a base portion 28 adjacent reservoir layer 26 and a layer of characters 30 which are integrally connected with, and made of the same material as, base portion 28.

The preparation of marking structure 22 shown in the figures may be accomplished as follows. A thermoplastic resin, such as polyvinyl chloride powder all of which will pass through a 75 mesh screen, is blended with a plasticizer, such as liquid dioctyl phthalate, forming a plastisol blend. A marking fluid such as ink, separately prepared from dyes, pigments, due solvents and vehicles which are substantially non-solvent to the resin, is added to the plastisol blend preferably in a weight ratio of marking fluid to plastisol blend within the range of about 0.1–1.0.

This preparation, referred to as the outer layer "premix", is then set aside and a separate preparation or premix is formed in the same manner except that the ratio of marking fluid to plastisol blend is preferably within the range of about 0.2–4.0. The former premix is used to form outer layer 24 and the latter premix is used in formation of reservoir layer 26, and may be referred to as the reservoir layer premix or the saturating premix.

An open-pored macroporous structure, such as open-pored polyurethane foam, is cut to the size and shape of the desired reservoir layer. This macroporous structure is exposed to a vacuum and in such condition is impregnated with the saturating premix which has previously been prepared. It is not necessary that the macroporous structure be totally filled by the saturating premix to the point where it can receive no additional material. However, saturating to the fullest extent reasonably possible appears to be desirable. While vacuum impregnation is highly preferred, other methods of impregnation may be devised and any method which would impregnate a significant quantity of saturating premix ino the structure would be acceptable.

A mold in the size and shape of the desired marking structure, having the desired characters engraved in the lower surface, is used to form the marking structure. The outer surface premix is poured into this mold to a total depth at approximately twice the thickness of the mold cavities used for forming characters. The impregnated macroporous structure is then placed in the mold on top of the outer layer premix. A cover plate is tightly secured to the mold to enclose the materials in a sealed, restricted space.

This mold is then heated to a high temperature, normally within the range of about 200°–400°F. for a period, normally, of about 5–50 minutes, depending primarily upon the size and shape of the marking structure being produced and the type of thermoplastic resin being used. During this process, which is referred to as "molding", the premix of the outer layer fuses with the premix of the reservoir layer. The thermoplastic resins of the outer and reservoir layers form aggregates and such aggregates are joined together at the interface 44 of the two layers. The aggregates of the outer layer define a network of pores which is partially filled with the marking fluid. The aggregates of the reservoir layer define, with the macroporous structure, a network of spaces which is partially filled with the marking fluid of the saturating premix.

The marking structure is cooled to room temperature within the sealed mold either by placing such sealed mold in an environment cooled below room temperature, such as by circulating cold fluids around the mold, or simply by placing the mold at room temperature for a period of time. The marking structure is then removed from the mold and is ready for mounting to a suitable holder such as holder 32 as shown in FIG. 1. The marking structure is then ready for use.

The thermoplastic resins used in the saturating premix and the outer premix need not be the same materials. However, the thermoplastic resins must be capable of fusing one to the other at interface 44 of outer layer 24 and reservoir layer 26 during the curing process. Preferably, the same resin is used in the reservoir layer as in the outer layer. A wide variety of thermoplastic resins are acceptable in the marking structure of this invention. Resins which fuse at a temperature below the boiling point of the marking fluid which is used therewith may be used in this invention. I have used synthetic resins and found them to be operable, Examples of acceptable thermoplastic resins are: polyvinyl chloride, polyvinyl acetate, polyvinylidene chloride, polyvinyl butyral, cellulose acetate butyrate, polymethyl methacrylate, polymethyl acrylate, polysulfone, and copolymers and combinations thereof. Highly preferred resins include: polyvinyl chloride, polyvinyl acetate, polyvinylidene chloride, copolymers of vinyl chloride and other ethylenically unsaturated monomers, and combinations thereof. The most preferred resins are copolymers of polyvinyl chloride.

Plasticizers are used in forming the two premixes in an amount of about 40–160 percent by weight of the resin. Examples of suitable plasticizers which can be used with the thermoplastic resins are numerous. The plasticizers which are used must be compatible with the resin in the sense that they soften the resin to allow the formation of aggregates of resin to form the marking structures of the invention. Examples of suitable plasticizers for use with polyvinyl chloride, polyvinyl acetate, polyvinylidene chloride, copolymers of vinyl chloride and other ethylenically unsaturated monomers, or combinations thereof are: tricresyl phosphate, dioctyl phthalate, dimethyl phthalate, dibutyl phthalate, butyl benzyl phthalate, trioctyl phosphate. Other acceptable plasticizers for use with various thermoplastic resins will be well-known to those skilled in the art to whom this invention has been disclosed. The aforementioned Leeds patents provide a list of plasticizers for use with a wide variety of thermoplastic resins, many of which are suitable for use in this invention. The use of plasticizers facilitates the formation of interconnected aggregates of thermoplastic resin. The aggregates of thermoplastic resin are sintered, that is, joined by heat, to form a cohesive structure.

The marking fluid used in this invention, in addition to being suitable for the intended purpose, must be incompatible with the thermoplastic resins which are used in the sense that such fluids must not substantially soften or dissolve such resins. An extremely wide variety of marking fluids known to those skilled in the art are acceptable. Inks are normally prepared from dyes, pigments, and dye solvents and vehicles. Such solvents and vehicles must not readily dissolve the resins. Examples are: aliphatic hydrocarbons, castor oil esters, ethanolamides, fatty acids, fatty acid esters, glyceryl esters, glycols, glycol esters, marine oils, mineral oils, polyethylene and polypropylene glycols, and vegetable oils. Dyes are generally used in such inks in amounts of from about 5–25 percent of total ink weight. The dyes, of course, must be soluble in the dye solvent used. Color pigments are normally dispersed in the vehicles used in amounts of from about 2 –20 percent of total ink weight. Particle size of pigments must be small enough to pass through the microporous outer layer of this invention.

Those skilled in the art who are made aware of this invention will know suitable marking fluids and be able to prepare suitable marking fluids. The term "marking fluid" refers to inks of various kinds and also to other fluids which can be applied in like manner, that is, by contact of the outer layer with the surface of intended application, for various other purposes.

The open-pored macroporous structure used in the reservoir layer of this invention may be made from a wide variety of materials, including thermoset elastomeric foams (such as polyurethane foam), thermoplastic foams such as polyvinyl chloride foam and polyethylene foam, sponge rubber, synthetic sponge material, natural sponge, and sintered nylon. Resilient materials, that is, materials which are at least slightly deformable but recover their original size and shape, are preferred. Examples of resilient materials are thermoset elastomeric foams, polyvinyl chloride foam, polyethylene foam, sponge rubber, synthetic sponge material and, natural sponge. This is apparently because the compressive action and recovery of shape which occur during application of marking fluid by pressure is helpful in encouraging passage of marking fluid from the reservoir layer to the outer layer. Open-pored thermoset elastomeric foams are highly preferred macroporous structures for use in this invention. The structures disclosed in the aforementioned Volz patent are highly superior as open-pored macroporous structures for use in this invention.

The structures described in the Volz patent are three-dimensional networks of interconnecting strands of a polyurethane resin. The strands are integrally interconnected by thickened nexus at spaced points so as to form the isotropic skeletal outline of a multitude of polyhedrons whose faces are polygonal, are common to a polyhedron adjacent thereto and are open and free from what Volz describes as permeatoidally degraded strands and nexus. Volz U.S. Pat. No. 3,171,820 is incorporated herein by reference.

Figure 4:
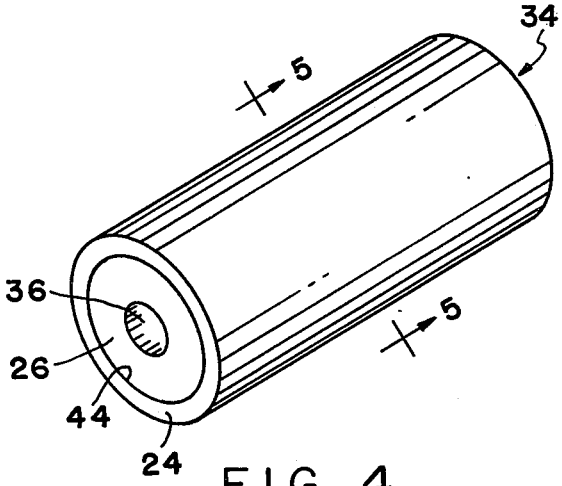
FIG. 4 is a perspective view of an ink roll according to this invention.
Figure 5:
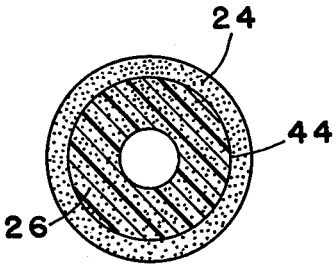
FIG. 5 is a sectional view of the roller of FIG. 4, taken along section 5—5 as indicated in FIG. 4.

FIG. 4 illustrates an ink roll 34 which may be used in automatic printing equipment to ink the surfaces of printing members by contact therewith. As illustrated in FIGS. 4 and 5, ink roll 34 has outer layer 24 and reservoir layer 26. Outer layer 24 is cylindrical in shape and continuous around ink roll 34. Reservoir layer 26 is an adjacent internal cylindrical structure, defining along its axis an opening 36 which is used for mounting of ink roll 34 to the equipment with which it is used.

Ink roll 34 is substantially similar to marking structure 22 in all respects except for its shape. Ink roll 34 may be made in cylindrical mold oriented in an up-and-down position, that is, with its axis vertical. The mold would have an annular cavity about a central rod, which is used for form opening 36. A macroporous structure generally in the shape and size of reservoir layer 26 is impregnated with saturating premix, just as previously described for structure 22, and placed over a rod within the mold being used. Then, the outer layer premix is poured into the mold to fill the remaining space, around the saturated macroporous structure. The mold is covered and processing continues as in the case of the marking structure previously described. In the manufacture of the ink rolls of this invention, it is not essential that the mold be sealed in a manner foreclosing the possibility of expansion. Indeed, I have found that some expansion in the direction of the axis of the rod is acceptable.

Figure 6:
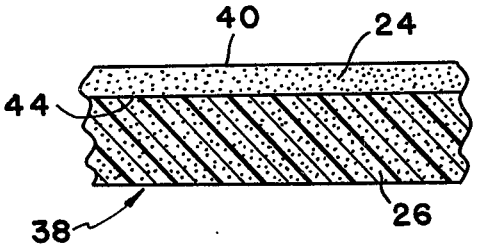
FIG. 6 is a partial sectional view of the marking structure of a stamp pad.

FIG. 6 illustrates a stamp pad 38, showing a portion thereof. Stamp pad 38 has layer 24 and reservoir layer 26 and is the same in all respects as structure 22 except that surface 40 of stamp pad 38 is flat and uninterrupted by characters such as characters 30 shown in FIGS. 2 and 3. Stamp pad 38 can be manufactured using the same method as that described for manufacture of marking structure 22.

Satisfactory alternative manufacturing methods will be apparent to those skilled in the art who have received disclosure of this invention.

Referring again to the amount of marking fluid in the outer and reservoir layers, the intended end use and quality of a marking structure of this invention will tend to dictate amounts of marking fluid and ratios of marking fluid. As indicated in the reservoir layer, the weight ratio of marking fluid to thermoplastic resin is within the range of about 0.2–4.0. Under a ratio of about 0.2, there will be no substantial feeding of marking fluid from the reservoir layer to the outer layer. Over a ratio of about 4.0, the reservoir layer will not contain the marking fluid in a desirable manner. A preferable ratio of marking fluid to thermoplastic resin for the reservoir layer is within the range of about 0.6–2.0. Within this range there will be excellent feeding of marking fluid from the reservoir layer to the outer layer and excellent retention of marking fluid within the reservoir layer.

In the outer layer, the ratio of marking fluid to thermoplastic resin should be within the range of about 0.1–1.0. Below about 0.1 there will be little or no application of marking fluid on the surface of intended application. Above about 1.0 the strength and structural integrity of the outer layer is drastically lessened and there may be a tendency to "bleed out" marking fluid even when the marking structure is not being used. If a very light impression or light deposition of marking fluid is intended, the ratio of marking fluid to thermoplastic resin should be fairly low. On the other hand, if a heavy impression or heavy deposition of marking fluid is intended, the ratio of marking fluid to thermoplastic resin should be fairly high. A highly preferred range for the ratio of marking fluid to thermoplastic resin in the outer layer is from about 0.3–0.7. Within this range, a strong impression may be applied and strength of the material is very good.

The amount of marking fluid used in the outer layer of the marking structure of this invention will determine the strength of the impression or the amount of deposition of marking fluid. Even if a significantly higher ratio of marking fluid to synthetic resin is used in the reservoir layer, the strength of the imprint, that is, the amount of marking fluid deposited on one contact or impression, will remain generally constant.

Figure 7:
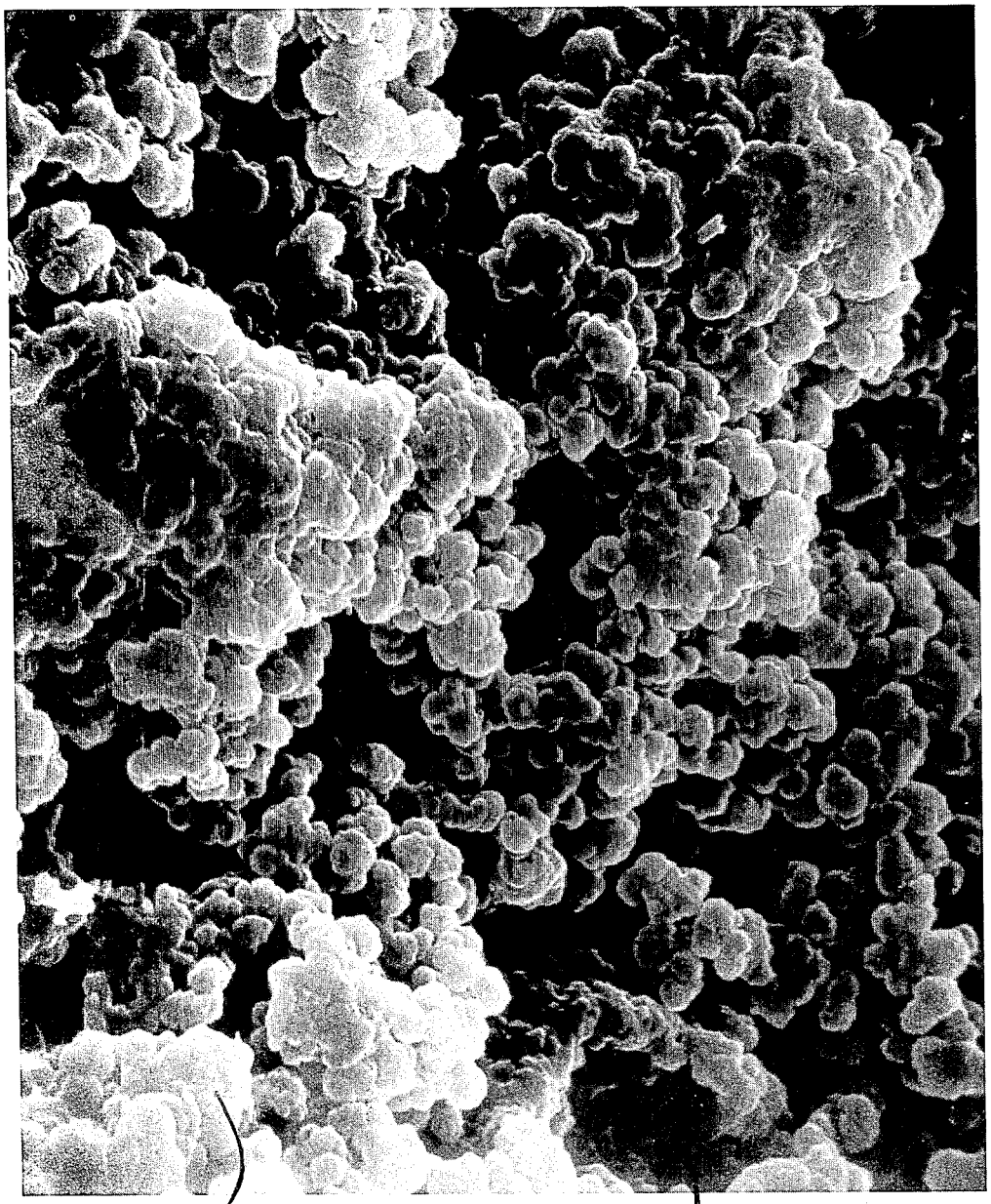
FIG. 7 is a photomicrograph, with a magnification of 5525X, taken of a partial cross-section of the outer layer of a marking structure of this invention.
Figure 8:
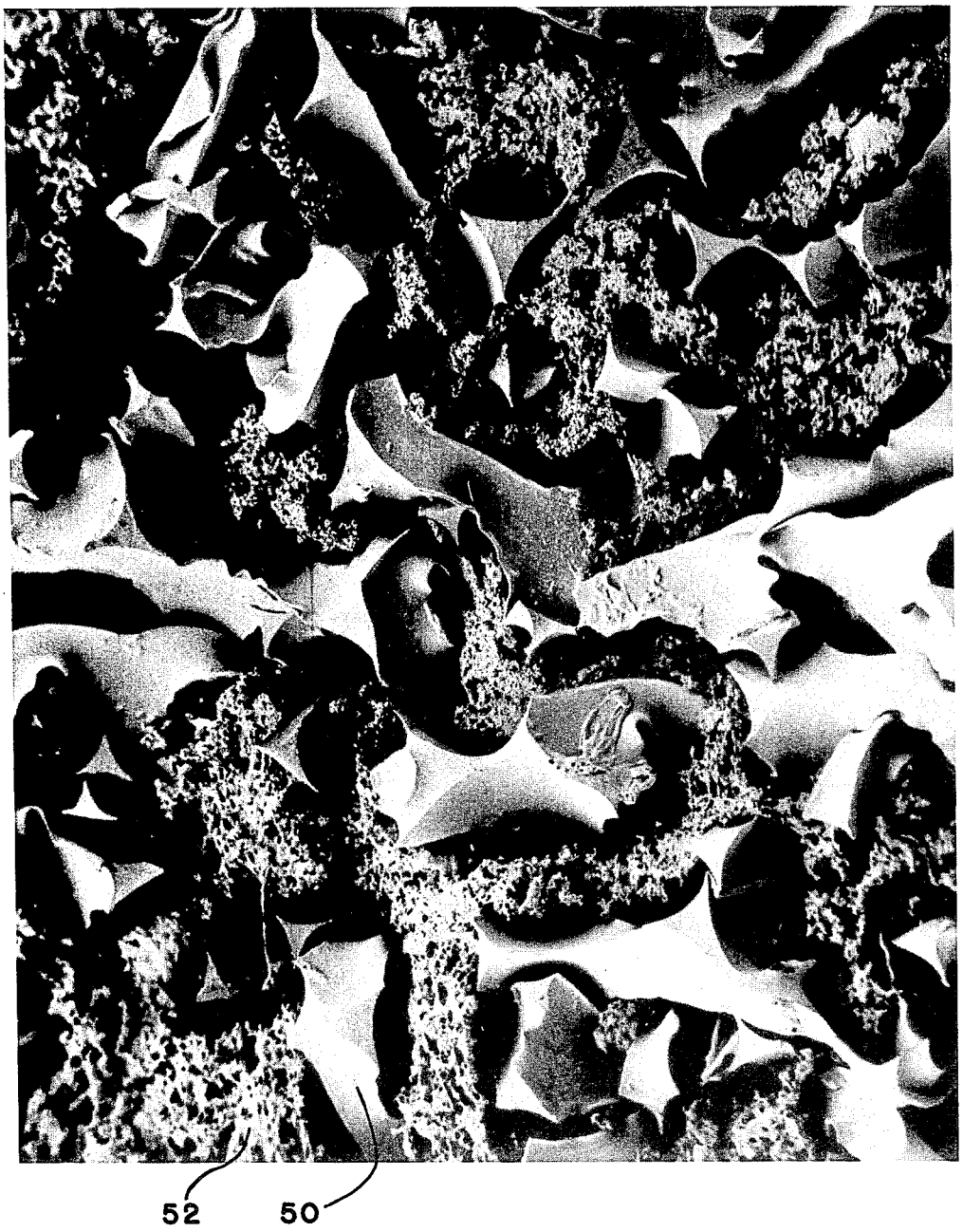
FIG. 8 is a photomicrograph, with a magnification of 186X, of a partial cross-section of the reservoir layer of the marking structure of FIG. 7.
Figure 9:
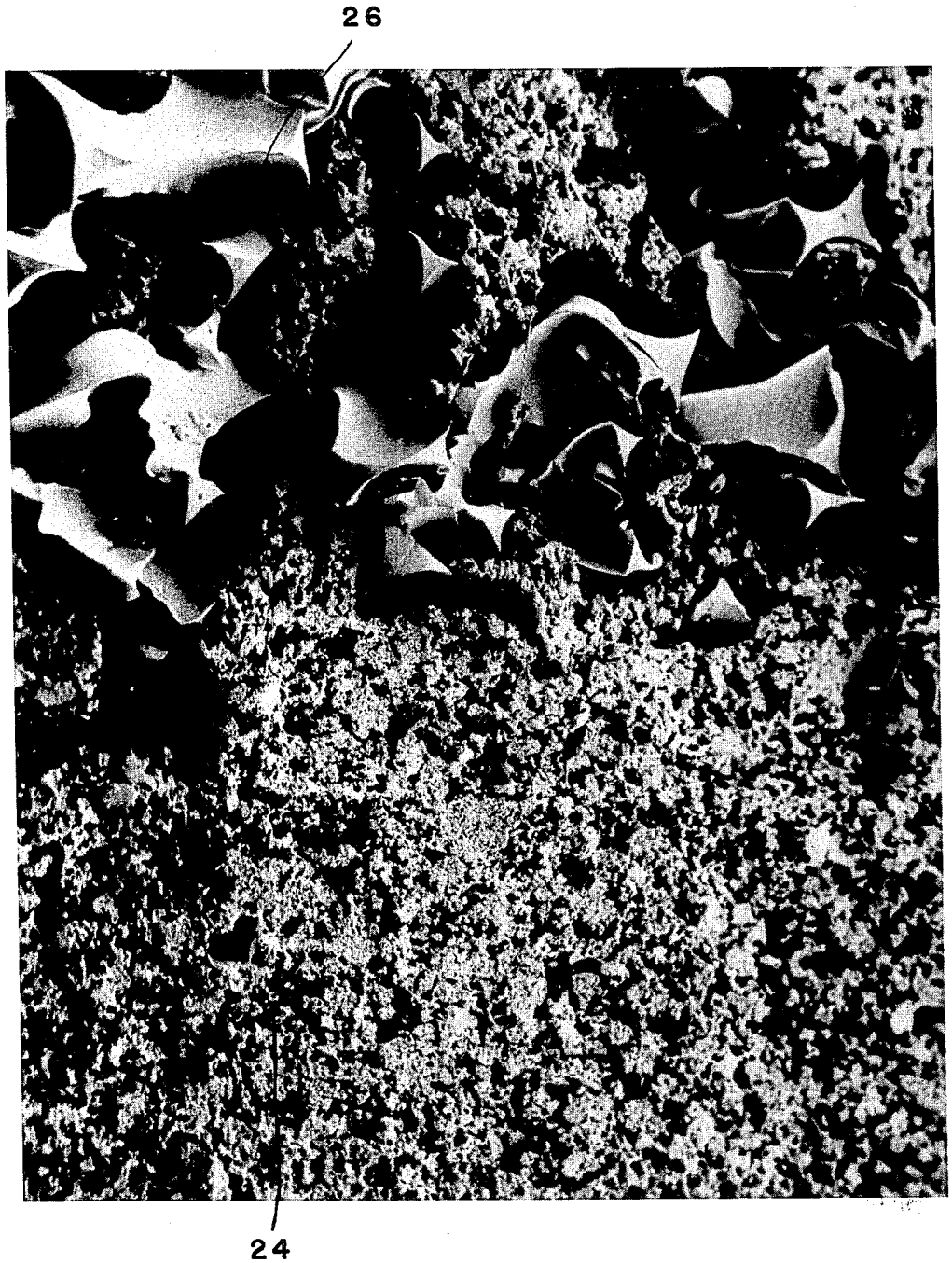
FIG. 9 is a photomicrograph, with a magnification of 186X, of a partial cross-section of the area of interface between the outer and reservoir layers of the marking structure of FIG. 7.

FIGS. 7, 8 and 9 are photomicrographs of the marking structure of this invention. In these figures, the marking fluid has been leached out of the marking structure such that the interconnected aggregates of thermoplastic resin and the macroporous structure may more readily appear.

FIG. 7 is a partial cross-section of the outer layer of a marking structure at a magnification of 5,525. The outer layer has interconnected aggregates 46 of plasticized thermoplastic resin. Aggregates 46 define a corresponding network of pores 48 which extends through the outer layer from the interface thereof with the reservoir layer to the marking surface. This network provides fluid communication from the interface to the marking surface.

FIG. 8 is a photomicrograph of a partial cross-section of the reservoir layer of a marking structure according to this invention, at a magnification of 186. The macroporous structure used is a network of interconnected strands of polyurethane elastomer. The specific material used is sold by Scott Paper Company of Philadelphia, Pennsylvania under the trademark Scottfelt. The structure includes interconnected strands 50. Contained within the voids between strands 50 is a microporous material formed of interconnected aggregates 52 of thermoplastic resin. Aggregates 52 and strands 50 together define a network of spaces which extends through the reservoir layer.

FIG. 9 is a photomicrograph of a partial cross-section of a marking structure according to this invention, taken at the interface of the reservoir layer and outer layer. FIG. 9 is taken at a magnification of 186. It may be seen that outer layer 24 and reservoir layer 26 both include interconnected aggregates of thermoplastic resin, and that such aggregates are connected at interface 44. This interconnection at interface 44 forms a strong bond between the two layers. At interface 44, as elsewhere, spaces are defined which allow fluid communication between the layers.

While it is normally preferred to have only one reservoir layer, in some cases a multiplicity of reservoir layers may be used. In such cases, the ratio of marking fluid to plasticized resin may be increased for each succeeding reservoir layer away from the outer layer.

EXAMPLES

In each of the following examples, a marking fluid is blended for use in the outer layer premix. This marking fluid (Marking Fluid A) may also be used in the reservoir layer premix; however, in many cases a separate marking fluid (Marking Fluid B) is prepared for use in the reservoir layer (or saturating) premix. Thereafter, a paste or slurry for use in preparing the outer layer premix is made by mixing a powdered thermoplastic resin, having one or more component resins, together with a liquid plasticizer, having one or more component plasticizers. This paste or slurry is referred to as Plastisol A. A separate paste or slurry (Plastisol B), for use in preparing the reservoir layer premix, is made by mixing a thermoplastic resin, having one or more component resins, together with a liquid plasticizer, having one or more component plasticizers. Plastisol A is mixed with Marking Fluid A to form the outer layer premix. Plastisol B is mixed with Marking Fluid B (which in some cases is Marking Fluid A) to form the reservoir layer premix. If a second reservoir layer is used, an additional marking fluid may be blended and an additional plastisol may be prepared. These are mixed to form the premix for use in such second reservoir layer.

In each of the following examples an open-pored macroporous structure is cut to the required size or made into the required size by some other fabrication means.

Other details of the manufacture of the marking structures of the following examples are given below:

EXAMPLE 1

Hand stamps are made in Examples 1–12. In Example 1, the following marking fluids and plastisols are prepared: :

| | |
|---|---|
| Marking Fluid A: | |
| 9 Parts | glycerol monoricinoleate |
| 9 Parts | oleic acid |
| 10 Parts | 2-ethylhexanediol-1,3 |
| 3.5 Parts | carbon black |
| 3.5 Parts | color index solvent black No. 5 dye |
| Marking Fluid B: | |
| 14 Parts | glycerol monoricinoleate |
| 14 Parts | oleic acid |
| 15 Parts | 2-ethylhexanediol-1,3 |
| 5.5 Parts | carbon black |
| 5.5 Parts | color index solvent black No. 5 dye |
| Plastisol A: | |
| 15 Parts | polyvinyl chloride copolymer resin (having the composition of 97% vinyl chloride, 3% vinyl acetate) (all of which will pass through a 80 mesh screen, i.e. 80 mesh). |
| 10 Parts | polyvinyl chloride homopolymer resin (all of which will pass through a 200 mesh screen, i.e. 200 mesh). |
| 20 Parts | tricresyl phosphate |
| 20 Parts | aromatic petroleum distillate (boiling range 475–525°F.) |
| Plastisol B: | |
| 10.5 Parts | polyvinyl chloride copolymer resin (having the composition of 97% vinyl chloride, 3% vinyl acetate) (80 mesh). |
| 6.5 Parts | polyvinyl chloride homopolymer resin (200 mesh). |
| 15 Parts | tricresyl phosphate |
| 14 Parts | aromatic petroleum distillate (boiling range 475–525°F.) |

An outer layer premix is made by mixing 35 parts of Marking Fluid A with 65 parts of Plastisol A. A reservoir layer premix is made by mixing 54 parts of Marking Fluid B with 46 parts of Plastisol B. In this example the weight ratio of marking fluid to plasticized resin in the reservoir layer will be about 120 percent greater than the comparable ratio for the outer layer.

An open-pored macroporous structure is prepared by cutting a piece of Scottfelt 5-600 polyurethane elastomeric foam to a rectangular block 2 ⅝ inches × ¾ inch × ¼ inch. Scottfelt 5-600 material is available from Scott Paper Company, Philadelphia, Penna. The designation "5-600", which is used by Scott Paper Company to identify various types of its Scottfelt material, is helpful in describing certain characteristics of the material. The "5" indicates a density of about 10 pounds per cubic foot, a factor of 2 being used by the manufacturer. The "600" indicates that 60 pores per lineal inch in the uncompressed state, a factor of 0.1 being used by the manufacturer. Other numerical designations for Scottfelt material may be interpreted in the same manner.

The macroporous structure is submerged in the reservoir layer premix, which is contained in a small vessel capable of receiving the prepared macroporous structure. Thereafter, the vessel with its submerged macroporos structure is placed in a vacuum chamber and subjected to a vacuum for about 5 minutes. During this period the air is removed from within the macroporous structure. As the vessel is removed from the vacuum chamber, the atmospheric pressure forces reservoir layer premix into the pores of the macroporous structure.

An aluminum mold is prepared having an engraved cavity with dimensions 2 ⅝ inches × ¾ inch with a ⅜ inch base depth and an engraved relief of an additional 0.75 inches in depth.

The outer layer premix is poured into the mold, adjacent and covering the marking face of the mold and filling the cavities which will define printing characters. The premix is poured to a total depth of about 0.15 inches including the depth of the characters engraved in the mold. The saturated macroporous structure is then placed snugly within the mold adjacent to and in contact with the outer layer premix. The saturated macroporous structure extends beyond the open end of the mold because of slight swelling during saturation. The mold is closed to compress this structure and form a confined space of generally fixed dimensions.

The closed mold is then heated at a temperature of 265°C. for a period of 15 minutes under a pressure of 10 pounds per square inch. After the heating process, the mold is cooled under atmospheric pressure. After cooling, the marking structure is removed from the mold and is ready for mounting to suitable mounting apparatus, such as that shown in FIG. 1.

EXAMPLE 2

The following marking fluids and plastisols are prepared:

| | |
|---|---|
| Marking Fluid A: | |
| 20 Parts | glycerol monoricinoleate |
| 20 Parts | 2-ethylhexanediol-1,3 |
| 10 Parts | color index solvent black No. 5 dye |
| Marking Fluid B: | |
| 20 Parts | glycerol monoricinoleate |
| 20 Parts | 2-ethylhexanediol-1,3 |
| 12 Parts | color index solvent black No. 5 dye |
| 8 Parts | carbon black pigment |
| Plastisol A: | |
| 25 Parts | polyvinyl chloride copolymer resin (having the composition of 90% vinyl chloride, 10% vinyl acetate) (all of which will pass through a 75 mesh screen, i.e. 75 mesh) |
| 15 Parts | tricresyl phosphate |
| 10 Parts | aromatic petroleum distillate (boiling range 475°–525°F.) |
| Plastisol B: | |
| 12 Parts | polyvinyl chloride copolymer resin (having the composition of 90% vinyl chloride, 10% vinyl acetate) (75 mesh) |
| 15 Parts | tricresyl phosphate |
| 13 Parts | aromatic petroleum distillate (boiling range 475–525°F.) |

An outer layer premix is made by mixing 50 parts of Marking Fluid A with 50 parts of Plastisol A. The weight ratio of marking fluid to plasticized resin in the outer layer of this example is about 1.0. A reservoir layer premix is made by mixing 60 parts of Marking Fluid B with 40 parts of Plastisol B. In this example the weight ratio of marking fluid to plasticized resin in the reservoir layer is about 50% greater than the comparable ratio for the outer layer.

An open-pored macroporous structure is prepared by cutting a piece of sponge rubber (¼ inch open cell plain sponge) from Standard Rubber Products (Elk Grove Village, Illinois) to the same dimensions as used in Example 1. This macroporous structure is impregnated with reservoir layer premix by the same procedure as outlined in Example 1.

The mold and molding procedure are the same as in Example 1 except as specified. The closed mold is then heated at a temperature of 255°F. for a period of 10 minutes under a pressure of 20 pounds per square inch. After the heating process, the mold is cooled under atmospheric pressure. After cooling, the marking structure is removed from the mold and is ready for mounting to suitable mounting apparatus, such as that shown in FIG. 1.

EXAMPLE 3

The following marking fluids and plastisols and prepared:

| | |
|---|---|
| Marking Fluid A: | |
| 12 Parts | glycerol monoricinoleate |
| 9 Parts | propylene glycol |
| 3 Parts | color index solvent red No. 36 dye |
| Marking Fluid B: | |
| 15 Parts | glycerol monoricinoleate |
| 12.5 Parts | propylene glycol |
| 4.5 Parts | color index solvent red No. 36 dye |
| Plastisol A: | |
| 15 Parts | polyvinyl chloride homopolymer resin (200 mesh) |
| 15 Parts | polyvinyl chloride copolymer resin (having the composition of 97% vinyl chloride, 3% vinyl acetate) (80 mesh) |
| 30 Parts | dioctyl phthalate |
| 16 Parts | aromatic petroleum distillate (boiling range 475–525°F.) |
| Plastisol B: | |
| 12 Parts | polyvinyl chloride homopolymer resin (200 mesh) |
| 14 Parts | polyvinyl chloride copolymer resin (having the composition of 97% vinyl chloride, 3% vinyl acetate) (80 mesh) |
| 25 Parts | dioctyl phthalate |
| 17 Parts | aromatic petroleum distillate (boiling |

-continued
range 475–525°F.)

An outer layer premix is made by mixing 24 parts of Marking Fluid A with 76 parts of Plastisol A. The weight ratio of marking fluid to plasticized resin in the outer layer is about 0.3 in this example. A reservoir layer premix is made by mixing 32 parts of Marking Fluid B with 68 parts of Plastisol B.

An open-pored macroporous structure is prepared by cutting a piece of mechanically frothed vinyl foam having a density of 20 pounds per cubic foot to the same dimensions as used in Example 1. This macroporous structure is impregnated with reservoir layer premix by the same procedure as outlined in Example 1.

The mold and molding procedure are the same as in Example 1, except as specified. The closed mold is heated at a temperature of 245°F. for 10 minutes under a pressure of 10 pounds per square inch. After the heating process, the mold is cooled under atmospheric pressure. After cooling, the marking structure is removed from the mold and is ready for mounting to suitable mounting apparatus, such as that shown in FIG. 1.

EXAMPLE 4

The following marking fluids and plastisols are prepared:

| | |
|---|---|
| Marking Fluid A: | |
| 9 Parts | glycerol monoricinoleate |
| 9 Parts | oleic acid |
| 10 Parts | 2-ethylhexanediol-1,3 |
| 3.5 Parts | carbon black pigment |
| 3.5 Parts | color index solvent black No. 5 dye |
| Marking Fluid B: | |
| 20 Parts | glycerol monoricinoleate |
| 20 Parts | 2-ethylhexanediol-1,3 |
| 12 Parts | color index solvent black No. 5 dye |
| 8 Parts | carbon black pigment |
| Plastisol A: | |
| 10 Parts | polyvinyl chloride homopolymer resin (200 mesh) |
| 15 Parts | polyvinyl chloride copolymer resin (having the composition of 97% vinyl chloride, 3% vinyl acetate (80 mesh) |
| 20 Parts | tricresyl phosphate |
| 20 Parts | aromatic petroleum distillate (boiling range 475–525°F.) |
| Plastisol B: | |
| 12 Parts | polyvinyl chloride copolymer resin (having the composition of 97% vinyl chloride, 3% vinyl acetate (80 mesh) |
| 15 Parts | tricresyl phosphate |
| 13 Parts | aromatic petroleum distillate (boiling range 475–525°F.) |

In addition, the following are prepared:

| | |
|---|---|
| Marking Fluid C: | |
| 30 Parts | glycerol monoriecnoleate |
| 35 Parts | 2-ethylhexanediol-1,3 |
| 7.5 Parts | carbon black pigment |
| 7.5 Parts | color index solvent black No. 5 dye |
| Plastisol C: | |
| 4 Parts | polyvinyl chloride copolymer resin (having the composition of 90% vinyl chloride, 10% vinyl acetate) (75 mesh) |
| 4 Parts | polymethyl methacrylate (about 50 mesh) |
| 6.5 Parts | tricresyl phosphate |
| 5.5 Parts | aromatic petroleum distillate (boiling range |

-continued
475–525°F.)

An outer layer premix is made by mixing 35 parts of Marking Fluid A with 65 parts of Plastisol A. A reservoir layer premix (Premix B) is made by mixing 60 parts of Marking Fluid B with 40 parts of Plastisol B. A second reservoir layer premix (Premix C) is made by mixing 80 parts of Marking Fluid C with 20 parts of Plastisol C.

Two open-pored macroporous structures are prepared by cutting a piece of Scottfelt 5-800 material and a piece of Scottfelt 5-600 material to rectangular blocks 2 ⅜ inches × ⅜ inch × ¼ inch.

The macroporous structure of Scottfelt 5-800 material is impregnated with the reservoir layer premix B and the macroporous structure of Scottfelt 5-600 material is impregnated with the reservoir layer premix C. Impregnation is carried out as in Example 1.

An aluminum mold having an engraved cavity with dimensions 2 ⅜ inches × ⅜ inch with a ⅝ inch base depth.

The outer layer premix is poured into the mold adjacent the marking surface, filling the printing characters and filling to an additional depth about equal to the depth of the characters. The macroporous structure saturated with Premix B is then placed snugly within the mold adjacent to and in contact with the outer layer premix. The macroporous structure saturated with Premix C is then placed snugly within the mold adjacent to and in contact with the other macroporous structure. The mold is closed to compress this structure and form a confined space of generally fixed dimensions.

The closed mold is then heated at a temperature of 265°F. for a period of 20 minutes under a pressure of 50 pounds per square inch. After the heating process, the mold is cooled under atmospheric pressure. After cooling, the marking structure is removed from the mold and is ready for mounting to suitable mounting apparatus, such as that shown in FIG. 1.

EXAMPLE 5

The following marking fluids and plastisols are prepared:

| | |
|---|---|
| Marking Fluid A: | |
| 7 Parts | glycerol monoricinoleate |
| 2 Parts | color index basic voilet No. 1 dye |
| Marking Fluid B: | |
| 15 Parts | glycerol monoricinoleate |
| 2 Parts | color index basic voilet No. 1 dye |
| Plastisol A: | |
| 46 Parts | polyvinyl chloride homopolymer resin (200 mesh) |
| 45 Parts | dioctyl phthalate |
| Plastisol B: | |
| 38 Parts | polyvinyl chloride homopolymer resin (200 mesh) |
| 45 Parts | dioctyl phthalate |

An outer layer premix is made by mixing 9 parts of Marking Fluid A with 91 parts of Plastisol A. The weight ratio of marking fluid to plasticized resin in the outer layer of this example is about 0.1. A reservoir layer premix is made by mixing 17 parts of Marking Fluid B with 83 parts of Plastisol B. The weight ratio of marking fluid to plasticized resin in the reservoir layer of this example is about 0.2.

An open-pored macroporous structure is prepared by cutting a piece of Scottfelt 3-800 material to the same dimensions as used in Example 1. This macroporous structure is impregnated with reservoir layer premix by the same procedure as outlined in Example 1.

The mold and molding procedure of Example 1 are used in this example. The closed mold is then heated at a temperature of 240°F. for a period of 15 minutes under a pressure of 10 pounds per square inch. After the heating process, the mold is cooled under atmospheric pressure. After cooling, the marking structure is removed from the mold and is ready for mounting to suitable mounting apparatus, such as that shown in FIG. 1.

EXAMPLE 6

The following marking fluids and plastisols are prepared:

| | |
|---|---|
| Marking Fluid A: | |
| 9 Parts | glycerol monoricinoleate |
| 9 Parts | oleic acid |
| 10 Parts | 2-ethylhexanediol-1,3 |
| 3.5 Parts | carbon black pigment |
| 3.5 Parts | color index solvent black No. 5 dye |
| Marking Fluid B: | |
| 30 Parts | glycerol monoricinoleate |
| 35 Parts | 2-ethylhexanediol-1,3 |
| 7.5 Parts | carbon black pigment |
| 7.5 Parts | color index solvent black No. 5 dye |
| Plastisol A: | |
| 10 Parts | polyvinyl chloride homopolymer resin (200 mesh) |
| 15 Parts | polyvinyl chloride copolymer resin (having the composition of 97% vinyl chloride, 3% vinyl acetate) (80 mesh) |
| 20 Parts | tricresyl phosphate |
| 20 Parts | aromatic petroleum distillate (boiling range 475–525°F.) |
| Plastisol B: | |
| 4 Parts | polyvinyl chloride copolymer resin (having the composition of 90% vinyl chloride, 10% vinyl acetate) (75 mesh) |
| 4 Parts | polymethyl methacrylate (about 50 mesh) |
| 6.5 Parts | tricresyl phosphate |
| 5.5 Parts | aromatic petroleum distillate (boiling range 475–525°F.) |

An outer layer premix is made by mixing 35 parts of Marking Fluid A with 65 parts of Plastisol A. A reservoir layer premix is made by mixing 80 parts of Marking Fluid B with 20 parts of Plastisol B. The weight ratio of marking fluid to plasticized resin in the reservoir layer of this example is quite high, about 4.8.

An open-pored macroporous structure is prepared by cutting a piece of Scottfelt 5-450 material to the same dimensions as used in Example 1. This macroporous structure is impregnated with reservoir layer premix by the same procedure as outlined in Example 1.

The outer layer premix is poured into the mold adjacent the marking surface, filling the cavities which will define printing characters. The premix is poured to a depth of about twice the depth of the characters engraved in the mold. The saturated macroporous structure is then placed within the mold adjacent and in contact with the outer layer premix. The saturated macroporous structure extends beyond the end of the mold. A backing layer about 0.010 inch thick of a vinyl plastisol (50% polyvinyl chloride homopolymer resin and 50% tricresyl phosphate) is placed on the saturated macroporous structure and allowed to fuse during the ensuing heating process.

The closed mold is heated at a temperature of 270°F. for a period of 10 minutes under a pressure of 50 pounds per square inch. After the heating process, the mold is cooled under atmospheric pressure. After cooling, the marking structure is removed from the mold and is ready for mounting to suitable mounting apparatus, such as that shown in FIG. 1.

The backing layer in this example is primarily to facilitate mounting; it also provides a good surface for an adhesive which can be used for mounting purposes

EXAMPLE 7

The following marking fluids and plastisols are prepared:

| | |
|---|---|
| Marking Fluid A: | |
| 20 Parts | glycerol monoricinoleate |
| 12 Parts | 2-ethylhexanediol-1,3 |
| 4 Parts | carbon black pigment |
| 6 Parts | color index solvent black No. 5 dye |
| Marking Fluid B: | |
| 25 Parts | glycerol monoricinoleate |
| 20 Parts | oleic acid |
| 10 Parts | propylene glycol |
| 6 Parts | carbon black pigment |
| 6 Parts | color index solvent black No. 5 dye |
| Plastisol A: | |
| 25 Parts | polyvinylidene chloride resin (about 80 Mesh) |
| 18 Parts | triethyl citrate |
| 15 Parts | aromatic petroleum distillate (boiling range 475–525°F.) |
| Plastisol B: | |
| 15 Parts | polyvinyl acetate powder (about 70 Mesh) |
| 10 Parts | dioctyl phthalate |
| 8 Parts | aromatic petroleum distillate (boiling range 475–525°F.) |

An outer layer premix is made by mixing 42 parts of Marking Fluid A with 58 parts of Plastisol. The weight ratio of marking fluid to plasticized resin in the outer layer of this example is about 0.7. A reservoir layer premix is made by mixing 67 parts of Marking Fluid B with 33 parts of Plastisol B.

An open-pored macroporous structure is prepared by cutting a piece of urethane foam Type 800 material from Foam Craft, Inc., Chicago, Ill., to the same dimensions as used in Example 1.

The mold and molding procedures are the same as those of Exmaple 1, except as noted. The closed mold is then heated at a temperature of 280°F. for a period of 10 minutes under a pressure of 25 pounds per square inch. After the heating process, the mold is cooled under atmospheric pressure. After cooling, the marking structure is removed from the mold and is ready for mounting to suitable mounting apparatus, such as that shown in FIG. 1.

EXAMPLE 8

The following marking fluids and plastisols are prepared:

| | |
|---|---|
| Marking Fluid A: | |
| 9 Parts | glycerol monoricinoleate |
| 9 Parts | oleic acid |
| 10 Parts | 2-ethylhexanediol-1,3 |

-continued

| | |
|---|---|
| 3.5 Parts | carbon black pigment |
| 3.5 Parts | color index solvent black No. 5 dye |
| Marking Fluid B: | |
| 20 Parts | glycerol monoricinoleate |
| 20 Parts | 2-ethylhexanediol-1,3 |
| 12 Parts | color index solvent black No. 5 dye |
| 8 Parts | carbon black pigment |
| Plastisol A: | |
| 10 Parts | polyvinyl chloride homopolymer resin (200 mesh) |
| 15 Parts | polyvinyl chloride copolymer resin (having the composition of 97% vinyl chloride, 3% vinyl acetate) (80 mesh) |
| 20 Parts | tricresyl phosphate |
| 20 Parts | aromatic petroleum distillate (boiling range 475–525°F.) |
| Plastisol B: | |
| 12 Parts | polyvinyl chloride copolymer resin (having the composition of 97% vinyl chloride, 3% vinyl (80 mesh) |
| 15 Parts | tricresyl phosphate |
| 13 Parts | aromatic petroleum distillate (boiling range 475–525°F.) |

An outer layer premix is made by mixing 35 parts of Marking Fluid A with 65 parts of Plastisol A. A reservoir layer premix is made by mixing 60 parts of Marking Fluid B with 40 parts of Plastisol B.

An open-pored macroporous structure is prepared by cutting a piece of Scottfelt 5-600 Material to the same dimensions as used in Example 1.

The mold and molding procedures are the same as in Example 1, except as noted. The closed mold is then heated at a temperature of 265°F. for a period of 15 minutes under a pressure of 20 pounds per square inch. After the heating process, the mold is cooled under atmospheric pressure. After cooling, the marking structure is removed from the mold and is ready for mounting to suitable mounting apparatus, such as that shown in FIG. 1.

EXAMPLE 9

The following marking fluids and plastisols are prepared:

| | |
|---|---|
| Marking Fluid A: | |
| 11 Parts | glycerol monoricinoleate |
| 16 Parts | propylene glycol |
| 3 Parts | color index solvent red No. 36 dye |
| Marking Fluid B: | |
| 14 Parts | glycerol monoricinoleate |
| 20 Parts | propylene glycol |
| 4 Parts | color index solvent red No. 36 dye |
| Plastisol A: | |
| 10 Parts | polyvinyl acetate (about 75 mesh) |
| 10 Parts | polyvinyl chloride copolymer resin (having the composition of 97% vinyl chloride, 3% vinyl acetate) (80 mesh) |
| 5 Parts | polyvinyl chloride homopolymer resin (200 mesh) |
| 25 Parts | tricresyl phosphate |
| 20 Parts | aromatic petroleum distillate (boiling range 475–525°F.) |
| Plastisol B: | |
| 12 Parts | polyvinyl chloride copolymer resin (having the composition of 97% vinyl chloride, 3% vinyl acetate (80 mesh) |
| 4 Parts | polyvinyl acetate (about 75 mesh) |
| 4 Parts | polyvinyl chloride homopolymer (200 mesh) |
| 20 Parts | tricresyl phosphate |
| 22 Parts | aromatic petroleum distillate (boiling range 475–525°F.) |

An outer layer premix is made by mixing 30 parts Marking Fluid A with 70 parts of Plastisol A. A reservoir layer premix is made by mixing 38 parts of Marking Fluid B with 62 parts of Plastisol B. The weight ratio of marking fluid to plasticized resin in the reservoir layer of this invention is about 0.6.

the open-pored macroporous structure is prepared by cutting a piece of Scottfelt 5-450 material to the same dimensions as used in Example 1. This macroporous structure is impregnated with reservoir layer premix by the same procedure as outlined in Example 1.

The mold and molding procedures are the same as those of Example 1. The closed mold is then heated at a temperature of 290°F. for a period of 10 minutes under a pressure of 20 pounds per square inch. After the heating process, the mold is cooled under atmospheric pressure. After cooling, the marking structure is removed from the mold and is ready for mounting to suitable mounting apparatus, such as that shown in FIG. 1.

EXAMPLE 10

Ink rolls are made in Examples 13 – 16. In Example 10, the following marking fluids and plastisols are prepared:

| | |
|---|---|
| Marking Fluid A: | |
| 9 Parts | glycerol monoricinoleate |
| 9 Parts | oleic acid |
| 10 Parts | 2-ethylhexanediol-1,3 |
| 3.5 Parts | carbon black pigment |
| 3.5 Parts | color index solvent black No. 5 dye |
| Marking Fluid B: | |
| 30 Parts | glycerol monoricinoleate |
| 35 Parts | 2-ethylhexanediol-1,3 |
| 7.5 Parts | carbon black pigment |
| 7.5 Parts | color index solvent black No. 5 dye |
| Plastisol A: | |
| 10 Parts | polyvinyl chloride homopolymer resin (200 mesh) |
| 15 Parts | polyvinyl chloride copolymer resin (having the composition of 97% vinyl chloride, 3% vinyl acetate (80 mesh) |
| 20 Parts | tricresyl phosphate |
| 20 Parts | aromatic petroleum distillate (boiling range 475–525°F.) |
| Plastisol B: | |
| 4 Parts | polyvinyl chloride copolymer resin (having the composition of 90% vinyl chloride, 10% vinyl acetate) (75 mesh) |
| 4 Parts | polymethyl methacrylate (about 50 mesh) |
| 6.5 Parts | tricresyl phosphate |
| 5.5 Parts | aromatic petroleum distillate (boiling range 475–525°F.) |

An outer layer premix is made by mixing 35 parts of Marking Fluid A with 65 parts of Plastisol A. A reservoir layer premix is made by mixing 80 parts of Marking Fluid B with 20 parts of Plastisol B.

An open-pored macroporous structure is prepared by die cutting a piece of Scottfelt 5-800 material to a cylindrical annular block have dimensions of 1¾ inches O.D. × 1 inch I.D. × ½ inch.

The macroporous structure is submerged in the reservoir layer premix, which is contained in a small vessel capable of receiving the macroporous structure. Thereafter, the vessel with its submerged macroporous structure is placed in a vacuum chamber and subjected to a vacuum for about 10 minutes. During this period the air is removed from within the macroporous structure. As the vessel is removed from the vacuum chamber, the atmospheric pressure forces reservoir layer premix into the pores of the macroporous structure.

An aluminium mold is prepared having a cylindrical cavity with a center core piece. The saturated macroporous structures are slipped onto the mold core, which are the same size as the inside diameter of the macroporous structures. The outer layer premix is poured into the mold adjacent to the cylindrical outer wall of the mold cavity and around the periphery of the saturated macroporous structure.

The mold is closed to compress this structure and form a confined space of generally fixed dimensions.

The closed mold is then heated at a temperature of 265°F. for a period of 20 minutes under a pressure of 1 pound per square inch. After the heating process, the mold is cooled under atmospheric pressure. After cooling, the marking structure is removed from the mold and is ready for use.

This procedure may be used to form ink rolls, which are used to ink printing characters of a transfer media by contact therewith. Another possibility is to engrave characters in the mold outer wall, to form printing rolls, useful by direct application.

EXAMPLE 11

The following marking fluids and plastisols are prepared:

| | |
|---|---|
| Marking Fluid A: | |
| 9 Parts | glycerol monoricinoleate |
| 9 Parts | oleic acid |
| 10 Parts | 2-ethylhexanediol-1,3 |
| 3.5 Parts | carbon black pigment |
| 3.5 Parts | color index solvent black No. 5 dye |
| Marking Fluid B: | |
| 14 Parts | glycerol monoricinoleate |
| 14 Parts | oleic acid |
| 15 Parts | 2-ethylhexanediol-1,3 |
| 5.5 Parts | carbon black pigment |
| 5.5 Parts | color index solvent black No. 5 dye |
| Plastisol A: | |
| 10 Parts | polyvinyl chloride homopolymer resin (200 mesh) |
| 15 Parts | polyvinyl chloride copolymer resin (having the composition of 97% vinyl chloride, 3% vinyl acetate) (80 mesh) |
| 20 Parts | tricresyl phosphate |
| 20 Parts | aromatic petroleum distillate (boiling range 475–525°F.) |
| Plastisol B: | |
| 10.5 Parts | polyvinyl chloride copolymer resin (having the composition of 97% vinyl chloride, 3% vinyl acetate) (80 mesh) |
| 6.5 Parts | polyvinyl chloride homopolymer resin (200 mesh) |
| 15 Parts | tricresyl phosphate |
| 14 Parts | aromatic petroleum distillate (boiling range 475–525°F.) |

An outer layer premix is made by mixing 35 parts of Marking Fluid A with 65 parts of Plastisol A. A reservoir layer premix is made by mixing 54 parts of Marking Fluid B with 46 parts of Plastisol B.

An open-pored macroporous structure is prepared by die cutting a piece of Scottfelt 3-800 material to a cylindrical annular block having dimensions of ¾ inch O.D. × ¼ inch I.D. × ¼ inch.

The impregnation and molding procedures are as in Example 10, except as specified, forming an ink roll.

The closed mold is heated at a temperature of 290°F. for a period of 15 minutes under a pressure of 5 pounds per square inch. After the heating process, the mold is cooled under atmospheric pressure.

EXAMPLE 12

Ink pads are made in Examples 12 and 13. In Example 12, the following marking fluids and plastisols are prepared:

| | |
|---|---|
| Marking Fluid A: | |
| 20 Parts | glycerol monoricinoleate |
| 20 Parts | 2-ethylhexanediol-1,3 |
| 10 Parts | color index solvent black No. 5 dye |
| Marking Fluid B: | |
| 20 Parts | glycerol monoricinoleate |
| 20 Parts | 2-ethylhexanediol-1,3 |
| 12 Parts | color index solvent black No. 5 dye |
| 8 Parts | carbon black pigment |
| Plastisol A: | |
| 25 Parts | polyvinyl chloride copolymer resin (having the composition of 90% vinyl chloride, 10% vinyl acetate) (75 mesh) |
| 15 Parts | tricresyl phosphate |
| 10 Parts | aromatic petroleum distillate (boiling range 475–525°F.) |
| Plastisol B: | |
| 12 Parts | polyvinyl chloride copolymer resin (having the composition of 90% vinyl chloride, 10% vinyl acetate) (75 mesh) |
| 15 Parts | tricresyl phosphate |
| 13 Parts | aromatic petroleum distillate (boiling range 475–525°F.) |

An outer layer premix is made by mixing 50 parts of Marking Fluid A with 50 parts of Plastisol A. A reservoir layer premix is made by mixing 60 parts of Marking Fluid B with 40 parts of Plastisol B.

An open-pored macroporous structure is prepared by cutting a piece of Scottfelt 5-1000 material to dimensions of 5 inches × 2½ inches × ¼ inch. The impregnation procedure specified in Example 1 is used in this example.

A brass mold is made having a rectangular block cavity 5 inches × 2½ inches, and having a depth of ⅜ inch. The outer layer premix is poured into the mold adjacent the marking surface, filling the cavity to a depth of about ⅛ inch. The saturated macroporous structure is then placed snugly within the mold adjacent and in contact with the outer layer premix. The saturated macroporous structure extends beyond the end of the mold cavity, because of some expansion during impregnation, and the mold is closed to compress this structure and form a confined space of generally fixed dimensions.

The closed mold is then heated at a temperature of 250°F. for a period of 15 minutes under a pressure of 20 pounds per square inch. After the heating process, the mold is cooled under atmospheric pressure. After cooling, the marking structure is removed from the mold and is ready for placement in a suitable container for use as an ink pad.

EXAMPLE 13

The following marking fluids and plastisols are prepared:

| | |
|---|---|
| Marking Fluid A: | |
| 12 Parts | glycerol monoricinoleate |
| 9 Parts | propylene glycol |
| 3 Parts | color index solvent red No. 36 dye |
| arking Fluid B: | |
| 15 Parts | glycerol monoricinoleate |

-continued

| | |
|---|---|
| 12.5 Parts | 2-ethylhexonediol-1,3 |
| 4.5 Parts | color index solvent red No. 36 dye |
| Plastisol A: | |
| 15 Parts | polyvinyl chloride homopolymer resin (200 mesh) |
| 15 Parts | polyvinyl chloride copolymer resin (having the composition of 97% vinyl chloride, 3% vinyl acetate) (80 mesh) |
| 30 Parts | dioctyl phthalate |
| 16 Parts | aromatic petroleum distillate (boiling range 475–525°F.) |
| Plastisol B: | |
| 14 Parts | polyvinyl chloride polymer resin (having the composition of 97% vinyl chloride, 3% vinyl acetate) (80 mesh) |
| 12 Parts | polyvinyl chloride homopolymer resin (200 mesh) |
| 25 Parts | dioctyl phthalate |
| 17 Parts | aromatic petroleum distillate (boiling range 475–525°F.) |

An outer layer premix is made by mixing 24 parts of Marking Fluid A with 76 parts of Plastisol A. A reservoir layer premix is made by mixing 32 parts of Marking Fluid B with 68 parts of Plastisol B.

An open-pored macroporous structure is prepared by cutting a piece of urethane foam (type 600 from Foam Craft, Inc., Chicago, Ill.) to the same dimensions as used in Example 12. The impregnation procedure specified in Example 1 is used in this example.

The mold and molding procedure is as in Example 12, except as specified. The closed mold is then heated at a temperature of 250°F. for a period of 15 minutes under a pressure of 20 pounds per square inch. After the heating process, the mold is cooled under atmospheric pressure. After cooling, the marking structure is removed from the mold and is ready for placement in a suitable container for use as an ink pad.

While in the foregoing specification, this invention has been described in relation to certain preferred embodiments, and many details have been set forth for purpose of illustration, it will be apparent to those skilled in the art that the invention is susceptible to additional embodiments and that certain of the details described herein can be varied considerably without departing from the basic principles of the invention.

I claim:

1. A multi-layered marker comprising:

an outer layer having a microporous material formed of aggregated particles of plasticized thermoplastic resin, said aggregated particles forming a substantially uniform cohesive structure defining a network of pores, and a marking fluid contained within said network, said fluid being substantially incompatible with said resin; and a reservoir layer underlying said outer layer and comprising an open-pored macroporous elastomeric structure, a microporous material impregnated within said macroporous structure, said microporous material being formed of aggregated particles of plasticized thermoplastic resin and defining within said macroporous structure a network of pores, and a marking fluid contained within said network, said fluid being substantially incompatible with the thermoplastic resin of said reservoir and outer layers, said aggregated particles of said reservior and outer layers being interconnected to join the layers, permitting the continuous passage of marking fluid from the network of pores of said reservoir layer to the network of pores of said outer layer.

2. The marking structure of claim 1 wherein said outer layer is of thickness substantially less than said reservoir layer.

3. The marking structure of claim 1 wherein said macroporous structure is a thermoset foam.

4. The marking structure of claim 3 wherein said resilient material comprises a network of interconnected strands of polyurethane.

5. The marking structure of claim 1 wherein said thermoplastic resin of said outer and reservoir layers is a resin selected from the group consisting of polyvinyl chloride, polyvinyl acetate, polyvinylidene chloride, copolymers of vinyl chloride and other ethylenically unsaturated monomers, and combinations thereof.

6. The marking structure of claim 5 wherein said thermoplastic resin of said outer and reservoir layers consists essentially of copolymers of vinyl chloride and other ethylenically unsaturated monomers.

7. The marking device of claim 3 wherein said thermoplastic resin of said outer and reservoir layers is selected from the group consisting of polyvinyl chloride, polyvinyl acetate, polyvinylidene chloride, copolymers of vinyl chloride and other ethylenically unsaturated monomers and combinations thereof.

8. The marking structure of claim 7 wherein said thermoplastic resin of said outer and reservoir layers consists essentially of copolymers of vinyl chloride and other ethylenically unsaturated monomers.

9. The marking structure of claim 4 wherein said thermoplastic resin of said outer and reservoir layers in a resin selected from the group consisting of polyvinyl chloride, polyvinyl acetate, polyvinylidene chloride, copolymers of vinyl chloride and other ethylenically unsaturated monomers, and combinations thereof.

10. The marking structure of claim 9 wherein said thermoplastic resin of said outer and reservoir layers consists essentially of copolymers of vinyl chloride and other ethylenically unsaturated monomers.

11. The marking structure of claim 1 wherein the weight ratio of marking fluid to plasticized resin in said reservoir layer is greater than the weight ratio of marking fluid to plasticized resin in said outer layer.

12. The marking structure of claim 11 wherein the weight ratio of marking fluid to plasticized resin in said reservoir layer is within the range of about 0.2–4.0 and the weight ratio of marking fluid to plasticized resin in said outer layer is within the range of about 0.1–1.0.

13. The marking structure of claim 12 wherein the weight ratio of marking fluid to plasticized resin in said reservoir layer is within the range of about 0.6–2.0 and the weight ratio of marking fluid to plasticized resin in said outer layer is within the range of about 0.3–0.7.

14. The marking structure of claim 11 wherein the weight ratio of marking fluid to plasticized resin in said reservoir layer is at least about 50 percent greater than the weight ratio of marking fluid to plasticized resin in said outer layer.

15. The marking structure of claim 14 wherein the weight ratio of marking fluid to plasticized resin in said reservoir is at least about 120 percent greater than the weight ratio of marking fluid to plasticized resin in said outer layer.

16. The marking structure of claim 2 wherein said outer layer comprises a base layer and a layer of printing characters integrally extending therefrom, said base layer being of thickness approximately equivalent to the thickness of said layer of characters.

* * * * *

UNITED STATES PATENT OFFICE

CERTIFICATE OF CORRECTION

Patent No. 3,971,315 Dated July 27, 1976

Inventor(s) Frederick C. Hansen

It is certified that error appears in the above-identified patent and that said Letters Patent are hereby corrected as shown below:

Column 4, Line 32, add a comma after "discussion".
Column 5, Line 44, delete "due" and insert in its place --dye--.
Column 7, Line 56, delete the comma at the end of the line.
Column 8, Line 38, after "has" insert --outer--.
Column 11, Line 49, delete "C." and insert --F.--.
Column 16, Line 53, delete "Exmaple" and insert --Example--.
Column 18, Line 7, delete "the" and insert --The--.
Column 18, Line 23, delete "13-16" and insert --10-11--.
Column 21, Line 47, (Claim 1, Line 1), delete "marker" and insert in its place --marking structure--.

Signed and Sealed this

Ninth Day of November 1976

[SEAL]

*Attest:*

RUTH C. MASON
*Attesting Officer*

C. MARSHALL DANN
*Commissioner of Patents and Trademarks*